United States Patent [19]

Nakayama et al.

[11] 4,432,788

[45] Feb. 21, 1984

[54] METHOD FOR MANUFACTURING NON-FIRED IRON-BEARING PELLET

[75] Inventors: Michio Nakayama, Kawasaki; Osamu Tajima, Kamakura; Seiji Matsui, Kawasaki; Hideyuki Yoshikoshi, Hino; Hiroshi Fukuyo, Yokohama, all of Japan

[73] Assignee: Nippon Kokan Kabushiki Kaisha, Tokyo, Japan

[21] Appl. No.: 366,199

[22] Filed: Apr. 7, 1982

[30] Foreign Application Priority Data

Apr. 23, 1981 [JP] Japan ..... 56-60640
Apr. 23, 1981 [JP] Japan ..... 56-60641

[51] Int. Cl.[3] ..... C22B 1/08
[52] U.S. Cl. ..... 75/3
[58] Field of Search ..... 75/3–5

[56] References Cited

U.S. PATENT DOCUMENTS

| | | | |
|---|---|---|---|
| 2,772,958 | 12/1956 | Beggs | 75/3 |
| 3,235,371 | 2/1966 | Volin et al. | 75/3 |
| 3,682,619 | 8/1972 | Holley | 75/3 |
| 4,049,435 | 9/1977 | Lotosh et al. | 75/3 |
| 4,093,448 | 6/1978 | Eliseev et al. | 75/3 |
| 4,119,455 | 10/1978 | Cass et al. | 75/3 |
| 4,239,530 | 12/1980 | Goksel | 75/34 |

FOREIGN PATENT DOCUMENTS

| | | | |
|---|---|---|---|
| 27666 | 8/1977 | Australia . | |
| 27667 | 8/1977 | Australia . | |
| 3665 | 8/1979 | European Pat. Off. | 75/3 |
| 47-29688 | 8/1972 | Japan . | |
| 339583 | 5/1972 | U.S.S.R. | 75/3 |
| 724585 | 3/1980 | U.S.S.R. | 75/3 |
| 779424 | 11/1980 | U.S.S.R. | 75/3 |

OTHER PUBLICATIONS

Coulson, J. M. et al., *Chemical Engineering*, vol. 1, 2nd Edition, Pergamon Press, pp. 404, 408–410, FIG. 10.3 (1965).

*Primary Examiner*—Michael L. Lewis
*Attorney, Agent, or Firm*—Frishauf, Holtz, Goodman & Woodward

[57] ABSTRACT

A method and an apparatus for manufacturing a non-fired iron-bearing pellet, which comprise:

supplying a green iron-bearing pellet containing a hydraulic binder and water into a treating furnace provided with a green iron-bearing pellet inlet at an end thereof and a non-fired iron-bearing pellet outlet at the other end thereof and having at least one heating gas blowing port and at least one heating gas discharge port, blowing through said blowing port into said treating furnace a gas containing a saturated steam at a temperature substantially equal to the heating target temperature of the green pellets, replenishing the heat of said gas lost through heat exchange with said green pellet with the condensation heat produced from condensation of at least part of the steam contained in said gas through heat exchange with said green pellets, and holding said green pellets at said target temperature for a prescribed period of time to harden said green pellets, thereby continuously manufacturing a non-fired iron-bearing pellets. The green iron-bearing pellets introduced into the furnace are first pretreated by contact with the gas which had been used to heat the already preheated pellets.

2 Claims, 8 Drawing Figures

METHOD FOR MANUFACTURING NON-FIRED IRON-BEARING PELLET

REFERENCE TO PATENTS, APPLICATIONS AND PUBLICATIONS PARTINENT TO THE INVENTION

As far as we know, there is available the following prior document pertinent to the present invention:

(1) Japanese Patent Publication No. 29688/72 dated Aug. 3, 1972.

The content of the prior art disclosed in the above prior document will be described hereinafter under the heading of the "BACKGROUND OF THE INVENTION."

FIELD OF THE INVENTION

The present invention relates to a method and an apparatus for manufacturing a non-fired iron-bearing pellet, which comprises manufacturing an iron-bearing pellet by hardening in a non-firing manner a green iron-bearing pellet prepared through addition of a hydraulic binder and water to main raw materials which comprise at least one of an iron ore fine and a dust mainly comprising iron oxides.

BACKGROUND OF THE INVENTION

The methods for manufacturing an iron-bearing pellet or an iron-bearing briquette (hereinafter referred to as "iron-bearing pellet") include the firing method and the non-firing method from a green iron-bearing pellet or a green iron-bearing briquette (hereinafter referred to as "green iron-bearing pellet") prepared by forming into a granular or solid form a mixture obtained through addition of a binder to main raw materials which comprise at least one of an iron ore fine and a dust mainly comprising iron oxides.

The non-firing method for manufacturing an iron-bearing pellet comprises continuously supplying a green iron-bearing pellet containing a hydraulic binder and water into a treating furnace, blowing a gas at a temperature of for example 100° C. into this treating furnace to heat this green pellet to a target temperature, and holding this green pellet at the target temperature for a prescribed period of time to harden the green pellet. Therefore this manufacturing method is more advantageous than the method for manufacturing an iron-bearing pellet through firing of a green iron-bearing pellet at a high temperature of over 1,000° C. in that it requires a smaller consumption of energy and simpler operations.

In the heat balance in the case where a green iron-bearing pellet supplied to a treating furnace is heated through blowing of a gas at a prescribed temperature when disregarding the thermal loss occurring in the furnace, the heat absorbed by the green pellet is equal to the heat released by the gas blown to the green pellet, as expressed in the following equation (1):

$$C_s M_s (T_{s1} - t_{so}) = \int_o^\tau C_g F (T_{go} - T_{g1}) dt \quad (1)$$

where, $C_s$: specific heat of the green iron-bearing pellet (Kcal/kg.°C.);

$M_s$: mass of the green iron-bearing pellet (kg);

$T_{so}$: charging temperature of the green iron-bearing pellet (°C.);

$T_{sl}$: heating temperature of the green iron-bearing pellet (°C.);

$C_g$: specific heat of the gas (Kcal/Nm$^3$.°C.);

F: flow rate of the gas (Nm$^3$/Hr);

$T_{go}$: blowing temperature of the gas (°C.);

$T_{gl}$: discharge temperature of the gas (°C.);

$\tau$: staying time of the green iron-bearing pellet in the furnace (Hr); and, $$\int_o^\tau C_g F (T_{go} - T_{g1}) dt:$$

integral value of the function $C_g F(T_{go} - T_{gl})$ in a time interval of from start of heating to $\tau$, and when the above function is any constant, the above integral value become the product of the above function and $\tau$.

The left-hand side of the above-mentioned equation (1) is dependent solely on the quantity of green iron-bearing pellet to be treated and the heating temperature, and irrespective of the heating method of green iron-bearing pellet. It is therefore necessary to set the right-hand side of the equation (1) at a value equal to that of the left-hand side. In this case, in order to minimize the gas flow rate F or the integral value thereof $F_\tau$, it is necessary to increase the gas blowing temperature $T_{go}$, whereas, in order to reduce the gas blowing temperature $T_{go}$, it is necessary to increase the gas flow rate F or the integral value thereof $F_\tau$. More particularly, in order to reduce the flow rate of the gas for heating the green iron-bearing pellet supplied to the treating furnace, it is necessary to blow the gas at a temperature higher than the heating target temperature of the green iron-bearing pellet. When the gas blowing temperature cannot be increased, on the other hand, it is necessary to increase the gas flow rate.

A method for manufacturing a non-fired iron-bearing pellet in a short time, in which a green iron-bearing pellet supplied in a treating furnace is subjected to a non-firing treatment, is disclosed in the Japanese Patent Publication No. 29688/72 dated Aug. 3, 1972 (hereinafter referred to as a "prior art").

The prior art discloses the method comprising: supplying a green iron-bearing pellet into a treating furnace, and blowing a steam at a temperature ranging from 160° to 230° C. into said treating furnace to heat said green iron-bearing pellet and thereby hardening the same to manufacture a non-fired iron-bearing pellet.

However, in the prior art, since the temperature of the gas (steam) to be blown into the treating furnace is increased to over the heating target temperature of the green iron-bearing pellet, overheating occurs in the part of the above-mentioned green iron-bearing pellet first brought into contact with this gas, and the water contained in this part is evaporated. As a result, this green iron-bearing pellet does not give a proper hydration reaction, resulting in a lower product quality.

On the other hand, a higher flow rate of the gas blown into the treating furnace leads to a higher manufacturing cost. When, for example, one ton of a green iron-bearing pellet of a temperature of 30° C. is heated by blowing a gas to increase the temperature of the pellet by 60° C. to a heating target temperature of 90° C. of the pellet on condition that an initial temperature of the blown gas is set at 100° C. which is higher by 10° C.

than the target temperature and a discharge temperature of the blown gas after heating the green iron-bearing pellet is set at 90° C., the quantity of the gas required for heating the green iron-bearing pellet to said target temperature would be so large as 3,000 $Nm^3$ per ton of the green iron-bearing pellet as follows as calculated by the above-mentioned equation (1):

$$0.16 \times 1000 \times 60 = 0.32 \times Fr \times 10$$
$$(C_s) \quad (M_s) \quad (T_{s1} - T_{so}) \quad (C_g) \quad (T_{go} - T_{g1})$$
$$Fr = 3{,}000$$

Under such circumstances, when manufacturing a non-fired iron-bearing pellet hardened through non-firing treatment of a green iron-bearing pellet, there is a strong demand for developing a method and an apparatus which permit manufacture of a high-quality non-fired iron-bearing pellet in a short time at a low cost, but such a method and an apparatus are not as yet proposed.

SUMMARY OF THE INVENTION

A principal object of the present invention is therefore to provide a method and an apparatus for manufacturing a non-fired iron-bearing pellet, which permit manufacture of a high-quality non-fired iron-bearing pellet in a short time at a low cost when manufacturing a non-fired iron-bearing pellet through heating of a green iron-bearing pellet in a treating furnace by a gas at a prescribed temperature blown into the treating furnace.

In accordance with one of the features of the present invention, there is provided a method for manufacturing a non-fired iron-bearing pellet, which comrises:

adding a hydraulic binder and water to main raw materials which comprise at least one of an iron ore fine and a dust mainly comprising iron oxides, and mixing same; forming the resultant mixture to prepare a green iron-bearing pellet; continuously supplying said green iron-bearing pellet into a treating furnace; blowing a gas at a prescribed temperature into said treating furnace to heat said green iron-bearing pellet to a target temperature; and, maintaining said green iron-bearing pellet at said target temperature for a prescribed period of time to harden said green iron-bearing pellet, thereby continuously manufacturing a non-fired iron-bearing pellet;

characterized in that:

said target temperature for heating a green iron-bearing pellet is set within the range of from 50° to 100° C.;

said gas contains saturated steam, and the temperature of said gas is substantially equal to said target temperature;

whereby at least part of said stream contained in said gas generates heat of condensation by condensation through heat exchange with the green iron-bearing pellet in said treating furnace, and thus, heat of said gas lost through said heat exchange with said green iron-bearing pellet is replenished with said condensation heat.

DETAILED DESCRIPTION OF THE PREFERRED EMBODIMENTS

Figure 2:
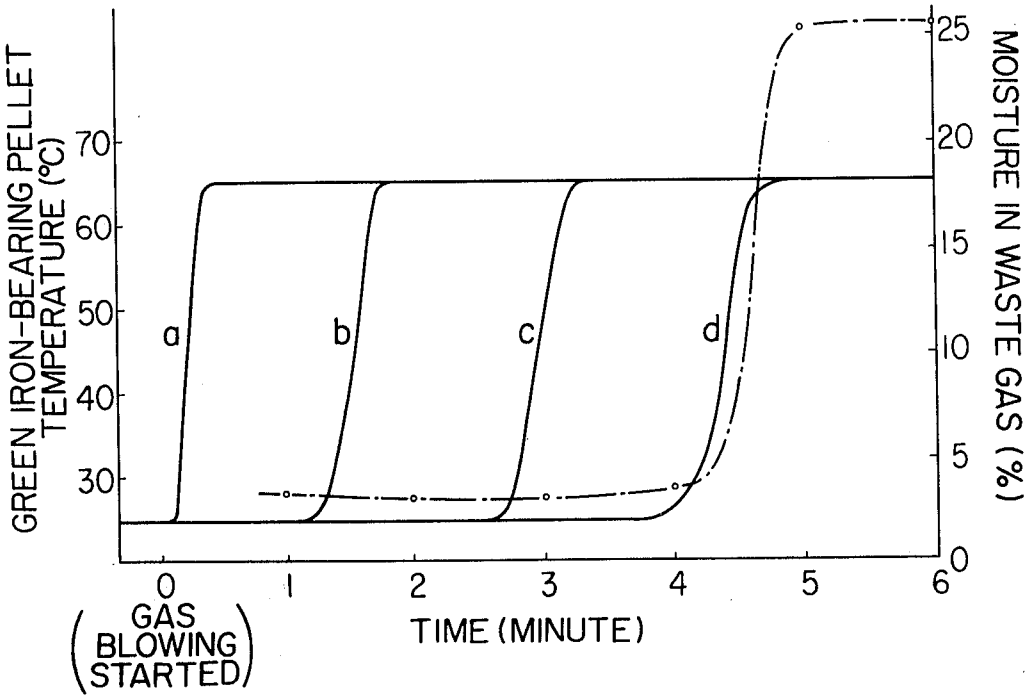
FIG. 2 is a graph illustrating the progress of the temperature of a green iron-bearing pellet in the heating apparatus and the moisture contained in exhaust gas in case that the green iron-bearing pellet is heated in the test heating apparatus shown in FIG. 1.

From the above-mentioned point of view, we carried out extensive studies with a view to developing a method and an apparatus for manufacturing a non-fired iron-bearing pellet, which permit manufacture of a high-quality non-fired iron-bearing pellet in a short time at a low cost.

When the temperature of saturated steam decreases, part of steam is condensed, generating condensation heat. When, for example, for the purpose of heating a green iron-bearing pellet to a temperature of 100° C., a gas containing a saturated steam at a temperature of 100° C. is blown into contact with the green iron-bearing pellets under ambient pressure (1 atm) to cause heat exchange with the green iron-bearing pellet, the decrease in the gas temperature to below 100° C. through this heat exchange immediately leads to condensation of part of the saturated steam contained in the gas, generating condensation heat. Thus, heat of the gas lost through heat exchange with the green iron-bearing pellet is replenished with this condensation heat, and as a result, the gas temperature is brought again to 100° C. Therefore, when using a gas containing saturated steam to heat a green iron-bearing pellet to a temperature of 100° C., a gas temperature of 100° C. would suffice. As a result, the part of the green iron-bearing pellet first brought into contact with the gas is not subjected to overheating and the water contained therein is never evaporated.

The present invention was made on the basis of the above-mentioned findings, and the method for manufacturing a non-fired iron-bearing pellet of the present invention comprises:

adding a hydraulic binder and water to main raw materials which comprise at least one of an iron ore fine and a dust mainly comprising iron oxides, and mixing same; forming the resultant mixture to prepare a green iron-bearing pellet; continuously supplying said green iron-bearing pellet into a treating furnace; blowing a gas at a prescribed temperature into said treating furnace to heat said green iron-bearing pellet to a target temperature; and, maintaining said green iron-bearing pellet at said target temperature for a prescribed period of time to harden said green iron-bearing pellet, thereby continuously manufacturing a non-fired iron-bearing pellet;

characterized in that:

said target temperature for heating a green iron-bearing pellet is set within the range of from 50° to 100° C.;

said gas contains a saturated steam, and the temperature of said gas is substantially equal to said target temperature;

whereby at least part of said steam contained in said gas generates a condensation heat by condensation through heat exchange with a green iron-bearing pellet in said treating furnace, and thus, heat of said gas lost through said heat exchange with said green iron-bearing pellet is replenished with said condensation heat.

In this method, the target temperature for heating a green iron-bearing pellet should be within the range of from 50° to 100° C. More specifically, if this temperature exceeds 100° C., the green iron-bearing pellet is overheated and the water contained therein is evaporated under the ambient pressure (1 atm), thus preventing a proper hydration reaction from taking place and making it impossible to manufacture a high-quality non-fired iron-bearing pellet. If this temperature is under 50° C., on the other hand, a long time is required for hardening the green iron-bearing pellet, and it is impossible to manufacture a non-fired iron-bearing pellet in a short time.

In this method, the gas to be blown into the treating furnace for heating a green iron-bearing pellet contains saturated steam and should have a temperature substantially equal to the above-mentioned heating target temperature of the green iron-bearing pellet. If, for example, the target temperature for heating a green iron-bearing pellet is set at 70° C., the gas blown into the treating furnace should contain a saturated steam and have a temperature of substantially 70° C. When the temperature of this gas decreases through heat exchange with the green iron-bearing pellet in the treating furnace, at least part of steam contained in the gas is condensed to generate condensation heat. Thus, heat of the gas lost through heat exchange with the green iron-bearing pellet is replenished with this condensation heat. As a result, the gas temperature is brought again to 70° C. by the effect of the above condensation heat of the steam, and hence, it is possible to rapidly heat the green iron-bearing pellet to a temperature of 70° C. with this gas.

The above-mentioned phenomenon may be expressed by the following equation (2):

$$C_S M_S (T_{S1} - T_{So}) = \int_0^{\tau} F\left(Y_1 - \frac{1 - Y_1}{1 - Y_o} \cdot Y_o\right) \rho_{H2O} \Delta H_{ev} dt \quad (2)$$

where, $Y_o$: molar fraction of steam corresponding to saturated steam pressure at the temperature before heating of the green iron-bearing pellet;

$Y_l$: molar fraction of steam corresponding to saturated steam pressure at the target temperature for heating the green iron-bearing pellet;

$\rho H_2O$: density (kg/Nm$^3$) under normal condition of steam; and, $\Delta H_{ev}$: condensation heat at the target temperature for heating the green iron-bearing pellet (Kcal/kg).

When, for example, a ton of green iron-bearing pellets at a temperature of 30° C. is heated by 60° C. to the heating target temperature of 90° C. through blowing of a gas at a temperature of 60° C. containing saturated steam by this method, the required quantity $F\tau$ of the blown gas, as calculated by the above-mentioned equation (2), is only 32 Nm$^3$ as shown below, and is thus far smaller than that required in the case of the above-mentioned conventional method:

$$\underset{(C_S)}{0.16} \times \underset{(M_S)}{1000} \times \underset{(T_{S1} - T_{So})}{60} = F\tau \left(\underset{(Y_1)}{0.692} - \frac{1 - 0.692}{1 - \underset{(Y_o)}{0.042}} \underset{(Y_o)}{0.042}\right) \times \underset{(\rho_{H2O})}{0.804} \times \underset{(\Delta H_{ev})}{545}$$

$F\tau = 32$

In this method, the temperature of the gas to be blown into the treating furnace can be previously set at a temperature higher by for example about 5° C. than the target temperature for heating the green iron-bearing pellet, since the gas may sometimes be cooled before reaching the treating furnace, leading to a lower temperature. So far as the saturation pressure of the saturated steam contained in the gas is 1 atm, the upper limit of the gas temperature is 100° C. It is however possible to increase this temperature to slightly over 100° C. by increasing the saturation pressure to over 1 atm.

Also in this method, preheating of the green iron-bearing pellet to a temperature within the range of from 40° to 90° C. prior to heating the same to the above-mentioned target temperature within the range of from 50° to 100° C. is effective in increasing the strength of the green iron-bearing pellet. This preheating may be conducted either in the treating furnace for heating the green iron-bearing pellet, or outside the above-mentioned treating furnace, but the most effective way is to preheat the green iron-bearing pellet in said treating furnace with the use of the gas after heating the green iron-bearing pellet to said target temperature, prior to heating the green iron-bearing pellet to the target temperature in said treating furnace.

In this method, furthermore, drying of the green iron-bearing pellet heated to the target temperature with a gas at a temperature within the range of from 100° to 300° C. is effective in increasing the strength thereof. In this case, a gas temperature of under 100° C. can give only a limited drying effect, whereas a gas temperature of over 300° C. leads rather to a lower strength. This drying of the green iron-bearing pellet may be effected either in said treating furnace or outside said treating furnace.

Now, the present invention is described by means of examples.

EXAMPLE 1

Figure 1:
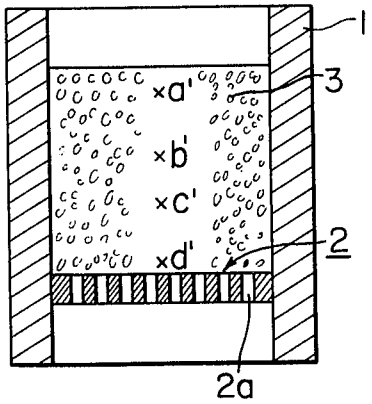
FIG. 1 is a schematic longitudinal sectional view of a test heating apparatus illustrating an embodiment of the method of the present invention.

FIG. 1 is a schematic longitudinal sectional view of a test heating apparatus 1 illustrating an embodiment of the method of the present invention. In FIG. 1, the heating apparatus 1 has a cylindrical shape with a diameter of 700 mm, and is provided with a plurality of vent holes 2*a* on the bottom 2 thereof. A non-fired iron-bearing pellet was manufactured by charging a green iron-bearing pellet 3 into the heating apparatus 1 to a height of 995 mm from the bottom 2 thereof, and blowing a gas containing a saturated steam into the heating apparatus 1 from above to heat and harden the green iron-bearing pellet in the heating apparatus 1. The manufacturing conditions were as follows:

(1) Composition of the green iron-bearing pellet:

| | |
|---|---|
| Iron ore fine | 90 wt. % |

-continued (hematite pellet feed)
Portland cement 10 wt. %

(2) Diameter of the green iron-bearing pellet:
from 10 to 17 mm
(13.5 mm on the average)

(3) Moisture contained in the green iron-bearing pellet:
8 wt. % (wet basis)

(4) Charging temperature of the green iron-bearing pellet:
25° C.

(5) Target temperature for heating the green iron-bearing pellet:
65° C.

(6) Quantity of charged green iron-bearing pellet:
810 kg (dry basis)

(7) Blown gas:
An air of 65 ° C. containing a saturated steam (8) Amount of blown gas:
Air 5.2 $Nm^3$/min.
Steam 1.38 kg/min.

(9) Blown gas temperature:
70° C.

(10) Velocity of blown gas passing through the heating apparatus:
0.377 m/sec.

(11) Pressure in the heating apparatus:
1 atm.

FIG. 2 is a graph illustrating the progress of the temperature of a green iron-bearing pellet in the heating apparatus and the moisture contained in the waste gas in case that the green iron-bearing pellet is heated under the above-mentioned conditions. In FIG. 2, the solid lines "a", "b", "c" and "d" represent the temperature at the respective positions in the heating apparatus of the green iron-bearing pellet 3 supplied into the heating apparatus 1 shown in FIG. 1. More particularly, the solid line "a" indicates the temperature at the part a' at a depth of 40 mm from the upper surface of the green iron-bearing pellet 3, the solid line "b" indicates that at the part b' at a depth of 330 mm, the solid line "c", the part c' at a depth of 670 mm, and the solid line "d", the part d' at a depth of 995 mm. In FIG. 2, the single-point chain line represents the moisture contained in the waste gas discharged from the vent hole 2*a* of the heating apparatus shown in FIG. 1.

As is clear from FIG. 2, the temperature of the green iron-bearing pellet 3 supplied into the heating apparatus 1 shown in FIG. 1 did not exceed the heating target temperature of 65° C. at any position in the heating apparatus 1, with a moisture in the green iron-bearing pellet of 9.4% after heating for 6 minutes, thus enabling to manufacture a high-quality non-fired iron-bearing pellet. The consumption of the air and steam blown during the heating time of 5 minutes was 32.1 $Nm^3$ per ton of the green iron-bearing pellet for the air, and 8.5 kg per ton of the green iron-bearing pellet for the steam.

EXAMPLE 2

Figure 3:
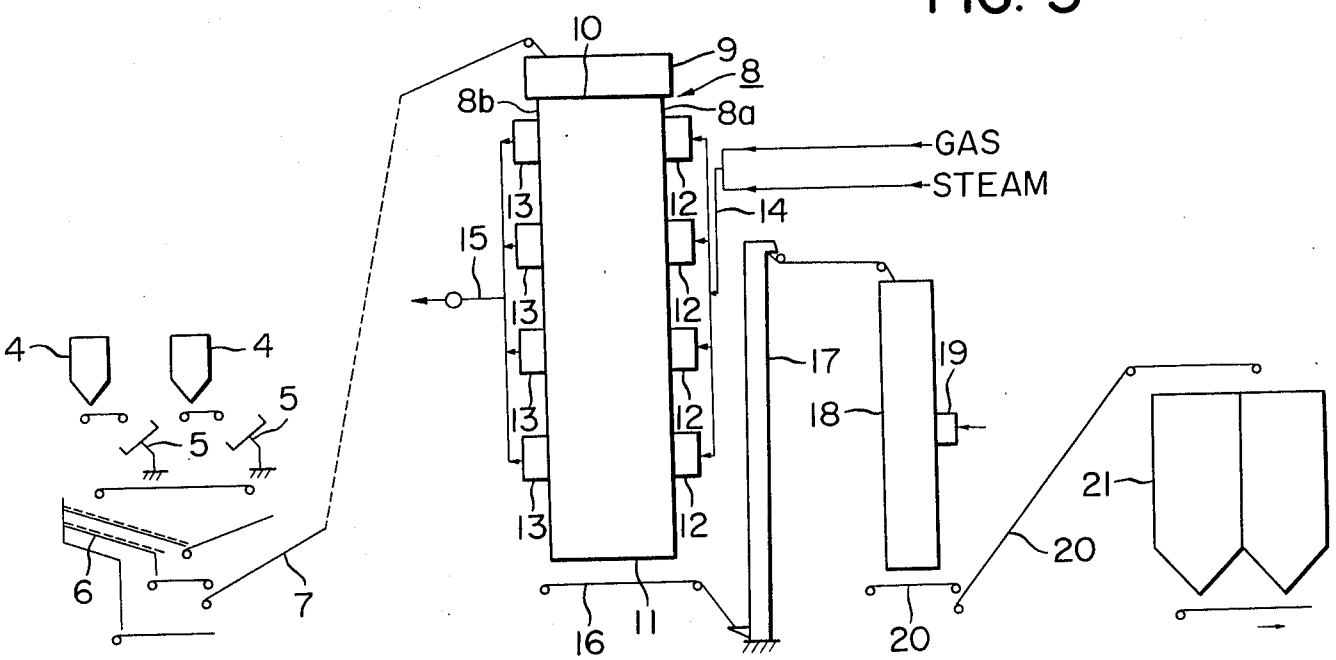
FIG. 3 is a schematic view illustrating an embodiment of the apparatus used in the method of the present invention.

FIG. 3 is a schematic drawing illustrating an embodiment of the apparatus used in the method of the present invention. In this example, the treating furnace comprises a shaft furnace. In FIG. 3, 4 is a storage bin for raw materials; 5 is a pelletizer; 6 is a screen; 7 is a conveyor; and, 8 is a shaft furnace. An iron ore fine mixed with a Portland cement which was a hydraulic binder and water was supplied alternately from the storage bins 4 to the pelletizers 5 and granulated in the pelletizers 5. A green iron-bearing pellet thus prepared was sieved through the screen 6, and the resultant green iron-bearing pellet with a prescribed particle size was transferred on the conveyor 7 to above the shaft furnace 8 and continuously supplied into the shaft furnace 8 through a feeding apparatus 9 installed above the shaft furnace 8.

The shaft furnace 8 is provided with a green iron-bearing pellet inlet 10 at the top thereof and a non-fired iron-bearing pellet outlet 11 at the bottom thereof. The shaft furnace 8 is adapted to contain and heat a green iron-bearing pellet continuously supplied from the green iron-bearing pellet inlet 10 into the shaft furnace 8. The shaft furnace 8 has on opposite side walls thereof 8*a* and 8*b* a plurality of heating gas blowing ports 12 and a plurality of heating gas discharge ports 13. The heating gas blowing ports 12 are adapted to blow into the shaft furnace 8 a gas for heating the green iron-bearing pellet supplied into the shaft furnace 8. The heating gas discharge ports 13 are adapted to discharge the gas after heating said green iron-bearing pellet from the shaft furnace 8.

A gas at a temperature of 65° C. containing a saturated steam was blown from the gas blowing ports 12 to a green iron-bearing pellet supplied into the shaft furnace 8 in a direction perpendicular to the flow of the green iron-bearing pellet which was heated with this gas. When the temperature of this gas decreased through heat exchange with the green iron-bearing pellet, at least part of steam contained in the gas generated condensation heat through condensation thereof, and the heat of the gas lost through heat exchange with the green iron-bearing pellet was replenished with this condensation heat to keep the gas temperature at 65° C. The green iron-bearing pellet was thus heated by this gas to 65° C. and was hardened in the shaft furnace 8 during the period up to discharge through the iron-bearing pellet outlet 11 in the form of a non-fired iron-bearing pellet.

The non-fired iron-bearing pellet discharged from the iron-bearing pellet outlet 11 was supplied on a conveyor 16 and a bucket elevator 17 into a drying oven 18 where the non-fired iron-bearing pellet was dried with the air at a temperature of 200° C. blown through a drying gas blowing port 19. The non-fired iron-bearing pellet thus dried was discharged from the drying oven 18, transferred on another conveyor 20 to a storage bin 21 where the non-fired iron-bearing pellet was stored.

Figure 4:
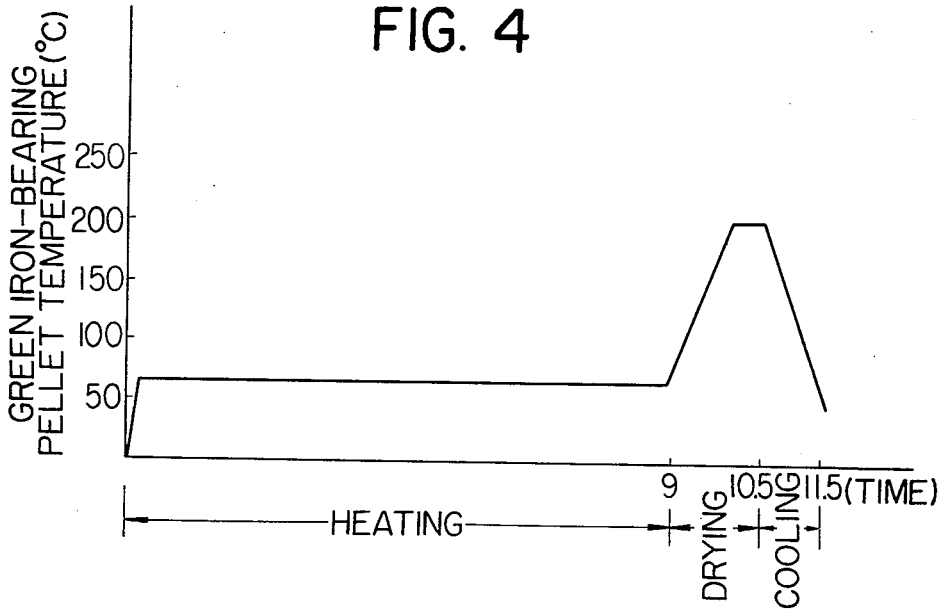
FIG. 4 is an example of heat pattern when manufacturing an iron-bearing pellet in the apparatus shown in FIG. 3.

FIG. 4 is an example of heat pattern in case that an iron-bearing pellet having a crash strength of at least 100 kg per pellet is manufactured in the apparatus shown in FIG. 3. A green iron-bearing pellet supplied into the shaft furnace 8 was heated with a gas at a temperature of 65° C. containing a saturated steam for a period of 9 hours, discharged from the shaft furnace 8, then dried with the air at a temperature of 200° C. in the drying oven 18 for a period of one hour and 30 minutes, and cooled with the air at a temperature of 20° C. for one hour to manufacture a non-fired iron-bearing pellet.

EXAMPLE 3

Figure 5:
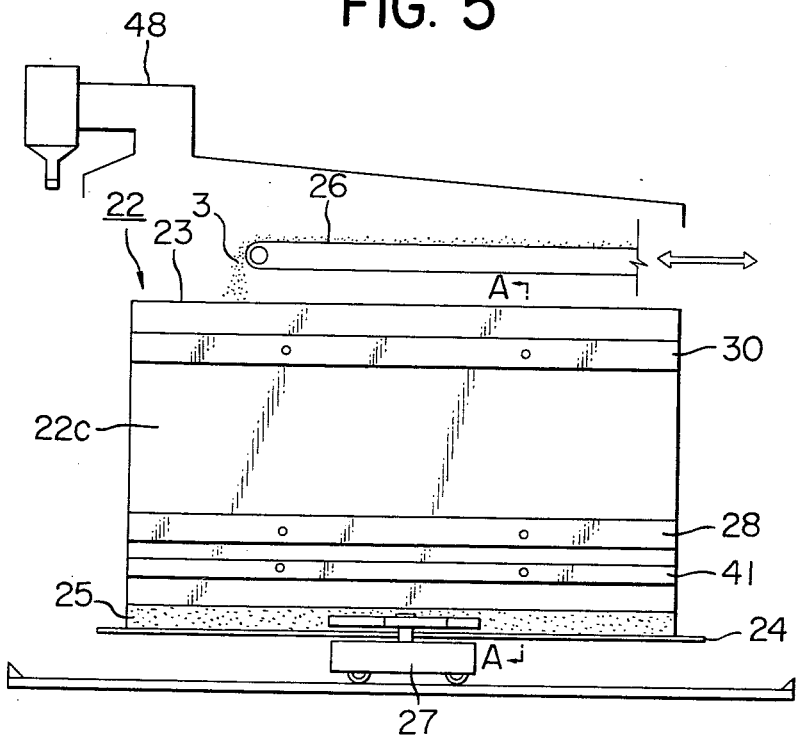
FIG. 5 is a schematic front view illustrating another embodiment of the apparatus used in the method of the present invention.
Figure 6:
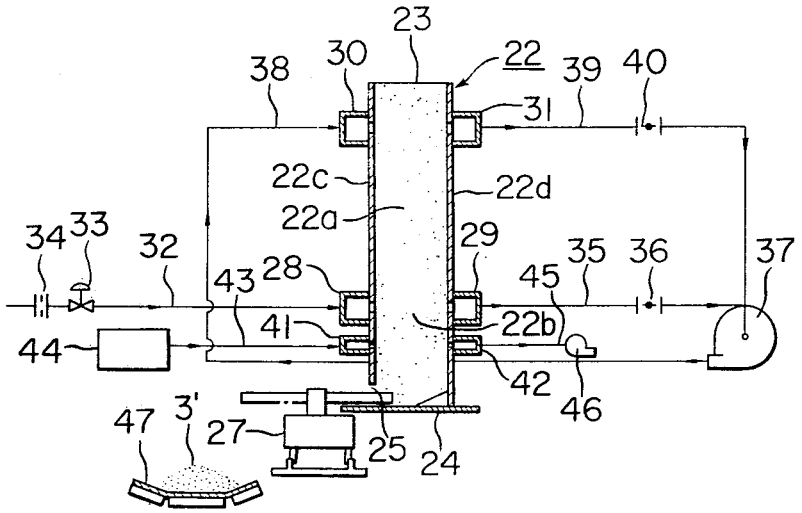
FIG. 6 is a schematic sectional view of FIG. 5 as cut along the line A—A.

FIG. 5 is a schematic front view illustrating another embodiment of the apparatus used in the method of the present invention, and FIG. 6 is a schematic sectional view of FIG. 5 as cut along the line A—A. In this example, the treating furnace comprises a shaft furnace 22. In FIGS. 5 and 6, the shaft furnace 22 has, for example, a height of 9 m, a width of 1.75 m and a length of 12 m. The shaft furnace 22 is provided with a green iron-bearing pellet inlet 23 over substantially the entire length of the shaft furnace 22 at the top thereof, and a non-fired iron-bearing pellet outlet 25 over substantially the entire length of the shaft furnace 22 at the bottom thereof along a bottom plate 24. In these figures, 26 is a feeder movable along the green iron-bearing pellet inlet 23 for supplying a green iron-bearing pellet 3 into the shaft furnace 22; 27 is a pellet remover of the rotating blade type movable along the non-fired iron-bearing pellet outlet 25 for discharging a non-fired iron-bearing pellet from the shaft furnace 22; 47 is a conveyor for transferring a non-fired iron-bearing pellet; and, 48 is a dust collector installed above the shaft furnace 22.

The shaft furnace 22 comprises an upper preheating zone *22a* and a lower heating zone *22b* following said preheating zone *22a*. The heating zone *22b* has on opposite side walls thereof *22c* and *22d* respectively a heating gas blowing port 28 and a heating gas discharge port 29. The preheating zone *22a* has on opposite side walls thereof *22c* and *22d* respectively a preheating gas blowing port 30 and a preheating gas discharge port 31. The heating gas blowing port 28 is connected with a supply pipe 32 for heating gas, and the supply pipe 32 is connected through a valve 33 to a steam feeder 34. The heating gas discharge port 29 is connected with a discharge pipe 35 for discharging through said discharge port 29 the heating gas blown from said blowing port 28 into the heating zone *22b*, and the discharge pipe 35 is connected through a valve 36 to a blower 37. The preheating gas blowing port 30 is connected with a supply pipe 38 for the preheating gas, and the supply pipe 38 is connected to said blower 37. The preheating gas discharge port 31 is connected with a discharge pipe 39 for discharging through said discharge port 31 the preheating gas blown from said blowing port 30 into the preheating zone *22a*. The discharge pipe 39 is connected through a valve 40 to said blower 37.

A heating gas blown through the supply pipe 32 and the heating gas blowing port 28 into the heating zone *22b* heats a green iron-bearing pellet 3 in the heating zone *22b*, and then discharged through the heating gas discharge port 29 into the discharge pipe 35. The waste gas discharged into the discharge pipe 35 is introduced, together with a waste gas discharged from the preheating gas discharge port 31, through the supply pipe 38 into the preheating gas blowing port 30, blown through the preheating gas blowing port 30 into the preheating zone *22a*, and, after preheating a green iron-bearing pellet in the preheating zone *22a*, discharged from the preheating gas discharge port 31 into the discharge pipe 39. The waste gas discharged into the discharge pipe 39 is introduced again, together with the waste gas discharged from the heating gas discharge port 29 into the preheating gas blowing port 30, and is thus used in recycle.

The shaft furnace 22 further has on opposite side walls thereof *22c* and *22d* at the lowermost parts a drying gas blowing port 41 and a drying gas discharge port 42 respectively. The drying gas blowing port 41 is connected with a drying gas supply pipe 43 which is in turn connected to a drying gas feeder 44. The drying gas discharge port 42 is connected with a discharge pipe 45 which is in turn connected to a blower 46.

Now, the following paragraphs describe a case where a non-fired iron-bearing pellet was manufactured with the use of the above-mentioned apparatus.

A green iron-bearing pellet 3 prepared by granulating a mixture comprising an iron ore fine mixed with a fine powdery granulated slag which was a hydraulic binder and water was continuously supplied into the shaft furnace 22 through the green iron-bearing pellet inlet 23 at the top thereof. A preheating gas at a temperature of 70° C. containing a saturated steam was blown from the preheating gas blowing port 30, to the green iron-bearing pellet 3 supplied into the preheating zone *22a* of the shaft furnace 22, in a direction perpendicular to the flow of the green iron-bearing pellet 3, to preheat the green iron-bearing pellet 3 with this preheating gas. When the temperature of this preheating gas decreased through heat exchange with the green iron-bearing pellet 3, at least part of the steam contained in the gas was condensed to generate condensation heat, and thus, the heat of the preheating gas lost through heat exchange with the green iron-bearing pellet 3 was replenished with this condensation heat and the gas temperature was kept at 70° C. The green iron-bearing pellet 3 was thus preheated to a temperature of 70° C. by the preheating gas while descending through the preheating zone *22a*.

A heating gas at a temperature of 100° C. containing a saturated steam was blown through the heating gas blowing port 28 to the green iron-bearing pellet 3 having thus descended through the preheating zone *22a* and moved into the heating zone *22b* to heat the green iron-bearing pellet 3 with this heating gas. The green iron-bearing pellet 3 was heated to 100° C. by the heating gas while descending through the heating zone *22b*. Then, a drying gas at a temperature of 250° C. was blown from the drying gas blowing port 41 to the green iron-bearing pellet 3 thus heated to 100° C. to dry the green iron-bearing pellet 3 with this drying gas.

Thus, the green iron-bearing pellet 3 supplied into the shaft furnace 22 through the green iron-bearing pellet inlet 23 at the top thereof was preheated in the preheating zone *22a* and then heated in the heating zone *22b* while descending through the shaft furnace 22, and dried and hardened with the drying gas into a non-fired iron-bearing pellet 3'. The non-fired iron-bearing pellet 3' was discharged from the non-fired iron-bearing pellet outlet 25 by the pellet remover 27, transferred on the conveyor 47 to the storage bin, and cooled while being thus transferred.

Part of the preheating gas at a temperature of 70° C. containing a saturated steam blown into the preheating zone *22a* descended, together with the green iron-bearing pellet 3 preheated to 70° C., through the preheating zone *22a* to the heating zone *22b*, and was discharged through the heating gas discharge port 29 of the heating zone *22b*. Therefore, a gaseous atmosphere of 70° C. containing a saturated steam would be kept by this gas in the preheating zone *22a*. Since, in the preheating zone *22a* as well as in the heating zone *22b*, the gas blown had a temperature of under 100° C., the green iron-bearing pellet was not overheated, thus preventing the contained moisture from being evaporated before hardening of the green iron-bearing pellet.

In the above-mentioned preheating and heating of the green iron-bearing pellet 3, the temperature of the preheating gas at a temperature of 70° C. containing a saturated steam blown from the preheating gas blowing port 30 decreased to 65° C. when the preheating gas was discharged from the preheating gas discharge port 31 after preheating the green iron-bearing pellet 3. The temperature of the heating gas at a temperature of 100° C. containing a saturated steam blown from the heating gas blowing port 28 decreased to 85° C. when the heating gas was discharged from the heating gas discharge port 29 after heating the green iron-bearing pellet 3. Therefore, the preheating gas at a temperature of 70° C. containing a saturated steam blown from the preheating gas blowing port 30 could be easily obtained by mixing the above-mentioned gas discharged from the preheating gas discharge port 31 and the gas discharged from the heating gas discharge port 29 at a prescribed ratio through the valves 36 and 40.

Figure 7:
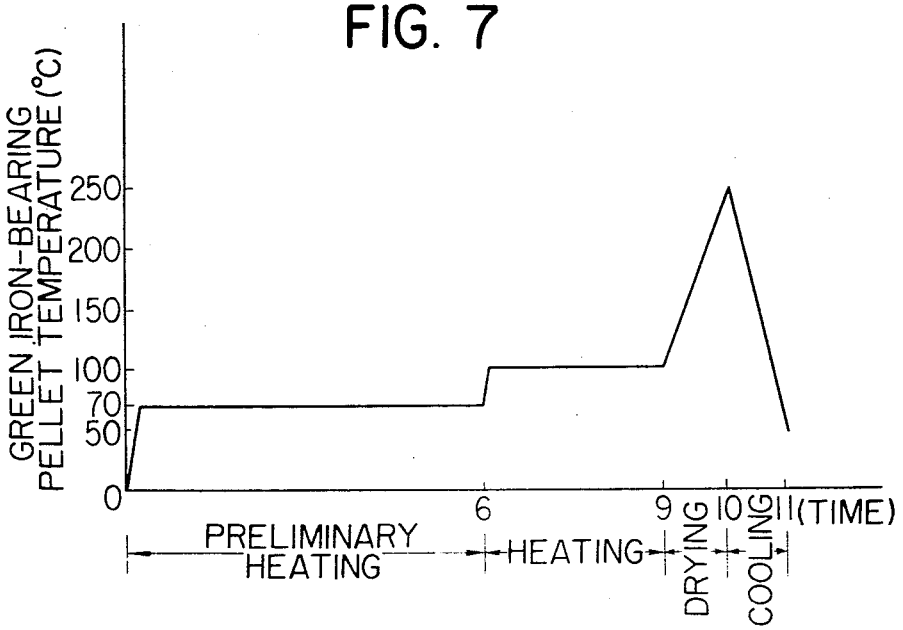
FIG. 7 is an example of heat pattern when manufacturing an iron-bearing pellet in the apparatus shown in FIGS. 5 and 6; and, FIG. 8 is a schematic sectional view illustrating further another embodiment of the apparatus used in the present invention.

FIG. 7 is an example of heat pattern in case that a non-fired iron-bearing pellet having a crash strength of over 100 kg per pellet is manufactured by the method described above. The green iron-bearing pellet 3 supplied into the shaft furnace 22 was preheated for a period of six hours in the preheating zone 22*a* with the preheating gas at a temperature of 70° C. containing a saturated steam, then heated for a period of three hours in the heating zone 22*b* with the heating gas at a temperature of 100° C. containing a saturated steam, then dried for a period of one hour at a temperature of 250° C., and then cooled for a period of one hour with the air at a temperature of 20° C., thus permitting manufacture of a non-fired iron-bearing pellet 3'.

Typical manufacturing conditions of non-fired iron-bearing pellet in the above-mentioned apparatus are as follows:

| | |
|---|---|
| (1) Green iron-bearing pellet supplied into the shaft furnace: | |
| Temperature | 30° C. |
| Moisture content | 8 wt. % |
| Quantity supplied | 45,290 kg/Hr |
| (2) Preheating gas blown into the preheating zone: | |
| Temperature | 70° C. |
| Quantity supplied | 6,586 kg/Hr |
| ( Air | 5,160 kg/Hr ) |
| Steam | 1,426 kg/Hr |
| (3) Preheating gas discharged from the preheating zone: | |
| Temperature | 50° C. |
| Quantity discharged | 4,166 kg/Hr |
| ( Air | 3,835 kg/Hr ) |
| Steam | 331 kg/Hr |
| (4) Green iron-bearing pellet and preheating gas in the preheating zone: | |
| Temperature | 70° C. |
| Quantity of green iron-bearing pellet | 45,290 kg/Hr |
| Quantity of preheating gas | 1,691 kg/Hr |
| ( Air | 1,325 kg/Hr ) |
| Steam | 366 kg/Hr |
| (5) Heating gas blown into the heating zone: | |
| Temperature | 100° C. |
| Quantity blown | 1,361 kg/Hr (steam) |
| (6) Heating gas discharged from the heating zone: | |
| Temperature | 85° C. |
| Quantity discharged | 2,420 kg/Hr |
| ( Air | 1,325 kg/Hr ) |
| Steam | 1,395 kg/Hr |
| (7) Non-fired iron-bearing pellet discharged from the shaft furnace: | |
| Temperature | 100° C. |
| Quantity discharged | 45,290 kg/Hr |

EXAMPLE 4

Figure 8:
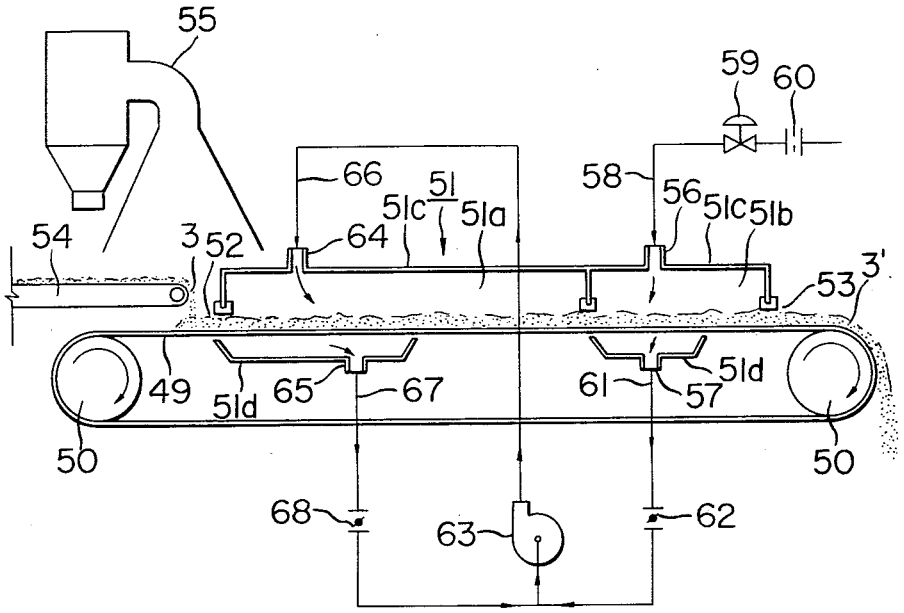

FIG. 8 is a schematic sectional view illustrating further another embodiment of the apparatus used in the method of the present invention. In this example, the treating furnace comprises a heating chamber 51 and a green iron-bearing pellet transfer system comprising a pair of pulleys 50 and an endless travelling grate 49. The heating chamber 51 is provided with a green iron-bearing pellet inlet 52 at an end thereof and a non-fired iron-bearing pellet outlet 53 at the other end thereof. An endless travelling grate 49 is adapted to pass continuously through the heating chamber 51 in the horizontal direction and continuously travel a green iron-bearing pellet 3, which is continuously supplied from said green iron-bearing pellet inlet 52 onto the endless travelling grate 49, through the heating chamber 51. In FIG. 8, 54 is a feeder for supplying the green iron-bearing pellet 3 to the green iron-bearing pellet inlet 52; and 55 is a dust collector installed above the green iron-bearing pellet inlet 52.

The heating chamber 51 comprises a preheating zone 51*a* and a heating zone 51*b* following said preheating zone 51*a*. The endless travelling grate 49 continuously passes sequentially through the preheating zone 51*a* and the heating zone 51*b*. The heating zone 51*b* is provided with a heating gas blowing port 56 and a heating gas discharge port 57 on the upper and lower walls 51*c* and 51*d* thereof respectively, which walls 51*c* and 51*d* put the endless travelling grate 49 therebetween. The heating gas blowing port 56 is connected with a supply pipe 58 for heating gas which is in turn connected through a valve 59 to a steam feeder 60. The heating gas discharge port 57 is connected with a discharge pipe 61 which is in turn connected through a valve 62 to a blower 63.

The preheating zone 51*a* is provided with a preheating gas blowing port 64 and a preheating gas discharge port 65 on the upper and lower walls 51*c* and 51*d* thereof respectively with the endless travelling grate 49 therebetween. The preheating gas blowing port 64 is connected with a supply pipe 66 for preheating gas which is in turn connected to said blower 63. The preheating gas discharge port 65 is connected with a discharge pipe 67 which is in turn connected through a valve 68 to the blower 63.

A heating gas blown through the supply pipe 58 and the heating gas blowing port 56 into the heating zone 51*b* heats a green iron-bearing pellet 3 on the endless travelling grate 49 which travels through the heating zone 51*b*, and is then discharged from the heating gas discharge port 57 into the discharge pipe 61. The waste gas discharged into the discharge pipe 61 is blown, together with a waste gas discharged from the preheating gas discharge port 65, through the supply pipe 66 and the preheating gas blowing port 64 into the preheating zone 51*a*, preheats the green iron-bearing pellet 3 on the endless travelling grate 49 which travels through the preheating zone 51*a*, and is then discharged from the preheating gas discharge port 65 into the discharge pipe 67. The waste gas discharged into the discharge pipe 67 is introduced, together with the waste gas discharged from the heating gas discharge port 57, to the preheating gas blowing port 64, and thus used in recycle.

Now, the following paragraphs described a case where a non-fired iron-bearing pellet is manufactured with the use of the above-mentioned apparatus.

In the apparatus used, the preheating zone 51*a* had a length of 25 m and an area of 125 $m^2$, the heating zone 51*b* had a length of 12.5 m and an area of 62.5 $m^2$, and the endless travelling grate 49 had a width of 5 m. A non-fired iron-bearing pellet was manufactured in this apparatus with a travelling speed of the endless travelling grate 49 of 4.2 m/Hr. A green iron-bearing pellet 3 was continuously supplied from the feeder 54 through the green iron-bearing pellet inlet 52 into the preheating zone 51*a* of the heating chamber 51. A preheating gas at a temperature of 70° C. containing a saturated steam was blown from the preheating gas blowing port 64 to the green iron-bearing pellet 3, travelling on the endless travelling grate 49 through the preheating zone 51*a*, in a direction perpendicular to the flow of the green iron-bearing pellet 3, to preheat the green iron-bearing pellet 3 with this preheating gas. The green iron-bearing pellet 3 was preheated to a temperature of 70° C. by this preheating gas while travelling through the preheating zone 51*a*. Then, a heating gas at a temperature of 100° C. containing a saturated steam was blown from the heating gas blowing port 56 to the green iron-bearing pellet 3, travelling through the heating zone 51*b*, in a direction perpendicular to the flow of the green iron-bearing pellet 3, to heat the green iron-bearing pellet 3 with this heating gas. The green iron-bearing pellet 3 was heated to a temperature of 100° C. and hardened by this heating gas while travelling through the heating zone 51*b*, into a non-fired iron-bearing pellet 3'. The non-fired iron-bearing pellet 3' was discharged through the non-fired iron-bearing pellet outlet 53 and dried in a drying oven (not shown).

The green iron-bearing pellet 3 supplied into the heating chamber 51 was prepared by granulating a mixture comprising an iron ore fine mixed with a fine powdery granulated slag which was a hydraulic binder and water. This green iron-bearing pellet had a temperature of 30° C., with a moisture content of 8 wt.%, and was supplied into the heating chamber 51 in an amount of 45,290 kg/Hr. The other conditions including those for the preheating gas blown into the preheating zone 51*a* and the heating gas blown into the heating zone 51*b* were the same as the conditions in Example 3. The heating chamber may comprise only a heating zone, not divided into a preheating and heating zones as in this Example.

In all the Examples described above, forcible drying of the heated and hardened pellet is not always necessary, but the heated and hardened pellet may be dried through spontaneous drying. It is possible to prevent occurrence of a trouble caused by an excessive moisture in the green iron-bearing pellet by drying the green iron-bearing pellet prior to charging into the treating furnace. It is also possible to prevent scaffolding from occurring in the treating furnace by supplying a heated and hardened iron-bearing pellet together with the green iron-bearing pellet, into the treating furnace at a prescribed ratio.

Preheating and heating of a green iron-bearing pellet in the treating furnace are not limited to the two-stage process as in the above-mentioned Examples, but may be carried out in three stages of, for example, 50° C., 70° C. and 100° C., or in four stages of, for example, 50° C., 70° C., 90° C. and 100° C. In all cases, mixing the waste gas and using the same in recycle permit blowing of a gas at any temperature and elimination of the necessity of a dust collector through prevention of release of the waste gas to open air. Blowing of a gas into the treating furnace in a direction perpendicular to the flow of green iron-bearing pellet allows effecitve and uniform heating of the green iron-bearing pellet in a simple apparatus.

The above-mentioned Examples have covered the cases of manufacture of a non-fired iron-bearing pellet, bit it is needless to mention that the method and the apparatus of the present invention may well be applicable also to the manufacture of a non-fired pellet of a manganese ore fine or a chromium ore fine.

According to the method and the apparatus for manufacturing a non-fired iron-bearing pellet of the present invention, as described above in detail, it is possible to manufacture a high-quality non-fired iron-bearing pellet with a small quantity of gas in a short time, without using a gas at a temperature higher than the heating target temperature of a green iron-bearing pellet at a low cost, thus providing many industrially useful effects.

What is claimed is:

1. An improved process for manufacturing a non-fired iron-bearing pellet, which comprises:

mixing a hydraulic binder and water with raw materials which comprise at least one of (i) iron ore fines and (ii) dust mainly comprising iron oxides, to form a mixture; forming said mixture into green iron-bearing pellets; continuously supplying said green iron-bearing pellets into a treating furnace which comprises a preheating zone and a heating zone; blowing a heating gas containing saturated steam having a temperature of from 50° to 100° C. into said heating zone to contact and to heat the green iron-bearing pellets in said heating zone to the temperature of said heating gas and to condense at least part of said saturated steam contained in said heating gas by heat exchange with said green iron-bearing pellets by said contact and said heating; utilizing said heating gas, which in the heating zone had been used to heat said green iron-bearing pellets and contains said saturated steam at least part of which had been condensed, as a preheating gas in said preheating zone of said treating furnace to preheat the green iron-bearing pellets in said preheating zone to a temperature of from 40° to 90° C.; and maintaining said green iron-bearing pellets thus preheated and then heated, at the temperature of from 50° to 100° C. for sufficient time to harden said green iron-bearing pellets; thereby continuously manufacturing non-fired iron-bearing pellets;

the improvement comprising withdrawing from said heating zone said (i) heating gas which had been used to heat the green iron-bearing pellets in said heating zone before said heating gas is introduced into said preheating zone to preheat the green iron-bearing pellets therein, and withdrawing from said preheating zone said (ii) preheating gas which had been used to preheat the green iron-bearing pellets therein and mixing said withdrawn gases (i) and (ii) in a ratio to have the desired preheating temperature and form the preheating gas which is used to heat said green iron-bearing pellets in said pre-heating zone and recirculating said preheating gas to said preheating zone, thereby preheating said green iron-bearing pellets.

2. The process of claim 1, wherein said green iron-bearing pellets which have been heated by contact with said heating gas and hardened are then dried by gas at a temperature of from 100° to 300° C.

* * * * *